US012050012B2

(12) United States Patent
Dederichs et al.

(10) Patent No.: US 12,050,012 B2
(45) Date of Patent: Jul. 30, 2024

(54) BURNER COMPONENT OF A BURNER, AND BURNER OF A GAS TURBINE HAVING A BURNER COMPONENT OF THIS TYPE

(71) Applicant: Siemens Energy Global GmbH & Co. KG, Bayern (DE)

(72) Inventors: Stefan Dederichs, Dusseldorf (DE); Michael Huth, Essen (DE); Ramsatish Kaluri, Bangalore (IN); Udo Schmitz, Mülheim an der Ruhr (DE); Anatol Schulz, Hennigsdorf (DE); Daniel Vogtmann, Düsseldorf (DE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/909,408

(22) PCT Filed: Dec. 10, 2020

(86) PCT No.: PCT/EP2020/085563
§ 371 (c)(1),
(2) Date: Sep. 5, 2022

(87) PCT Pub. No.: WO2021/197654
PCT Pub. Date: Oct. 7, 2021

(65) Prior Publication Data

US 2023/0151966 A1 May 18, 2023

(30) Foreign Application Priority Data

Mar. 31, 2020 (EP) ..... 20167166.6
Jun. 26, 2020 (DE) ..... 10 2020 207 940.4

(51) Int. Cl.
*F23R 3/28* (2006.01)
*F23R 3/12* (2006.01)

(52) U.S. Cl.
CPC ..... *F23R 3/286* (2013.01); *F23R 3/12* (2013.01)

(58) Field of Classification Search
CPC .... F23R 3/12; F23R 3/14; F23R 3/283; F23R 3/286; F23R 3/28; F23R 2900/03045;
(Continued)

(56) References Cited

U.S. PATENT DOCUMENTS 3,578,264 A 5/1971 Kuethe
4,260,367 A 4/1981 Markowski et al.
(Continued)

FOREIGN PATENT DOCUMENTS

CN 1131737 A 9/1996
CN 1133393 A 10/1996
(Continued)

OTHER PUBLICATIONS

Xu, Xiao; Numerical Studies of Combustion and Flow Characteristics in a Trapped Vortex Combustor; Jiangsu University of Science and Technology; Jun. 2020; English abstract on p. 7.
(Continued)

*Primary Examiner* — Stephanie Sebasco Cheng
*Assistant Examiner* — Jingchen Liu
(74) *Attorney, Agent, or Firm* — Wolter Van Dyke Davis, PLLC

(57) ABSTRACT

A burner component of a burner. The burner has a flow channel, in which combustion air flows in a flow direction from upstream to downstream. The burner component includes a wall portion, which adjoins the flow channel; a plurality of injection nozzles, which are arranged in the wall portion; and a plurality of vortex generators, which are arranged on the wall portion. The vortex generators have a concavely curved sloped surface rising in the flow direction to improve the distribution of the fuel in the combustion air.

18 Claims, 3 Drawing Sheets

(58) Field of Classification Search
CPC ..... F23D 14/64; F23D 14/24; F23D 14/02; F23D 14/105; F23D 2900/14021; F23D 2900/14701; F05D 2240/127; F05D 2260/2212
See application file for complete search history.

(56) References Cited

U.S. PATENT DOCUMENTS

| | | | | |
|---|---|---|---|---|
| 5,251,447 | A | 10/1993 | Joshi et al. | |
| 5,433,596 | A | 7/1995 | Dobbeling et al. | |
| 5,498,155 | A * | 3/1996 | Chyou | F15D 1/0015 431/185 |
| 5,588,826 | A | 12/1996 | Dobbeling | |
| 5,609,030 | A | 3/1997 | Althaus | |
| 5,626,017 | A | 5/1997 | Sattelmayer | |
| 5,791,892 | A * | 8/1998 | Dobbeling | F23D 14/62 431/284 |
| 9,021,811 | B2 | 5/2015 | Lam | |
| 10,982,857 | B2 | 4/2021 | Doh | |
| 2002/0026796 | A1 | 3/2002 | Gutmark | |
| 2004/0037162 | A1 | 2/2004 | Flohr | |
| 2010/0011770 | A1 | 1/2010 | Chila | |
| 2012/0079829 | A1 | 4/2012 | Berry et al. | |
| 2012/0285172 | A1 | 11/2012 | Poyyapakkam et al. | |
| 2015/0176412 | A1 | 6/2015 | Krueckels | |
| 2016/0298849 | A1 | 10/2016 | Yang et al. | |
| 2017/0089584 | A1 | 3/2017 | Poyyapakkam | |
| 2017/0108224 | A1* | 4/2017 | Beck | F23R 3/36 |
| 2017/0146242 | A1 | 5/2017 | Meadows et al. | |
| 2018/0149027 | A1 | 5/2018 | Yang | |
| 2018/0149360 | A1 | 5/2018 | Theuer | |
| 2021/0010674 | A1* | 1/2021 | Thariyan | F23R 3/14 |

FOREIGN PATENT DOCUMENTS

| | | | |
|---|---|---|---|
| CN | 103711753 | A | 4/2014 |
| CN | 104727857 | A | 6/2015 |
| CN | 105351112 | A | 2/2016 |
| CN | 106164592 | A | 11/2016 |
| CN | 106958835 | A | 7/2017 |
| CN | 108119914 | A | 6/2018 |
| CN | 108119916 | A | 6/2018 |
| DE | 4446611 | A1 | 6/1996 |
| EP | 0619457 | A1 | 10/1994 |
| EP | 0694740 | A2 | 1/1996 |
| EP | 0775869 | A2 | 5/1997 |
| EP | 0718561 | B1 | 3/2001 |
| EP | 1182398 | A1 | 2/2002 |
| EP | 1382379 | A2 | 1/2004 |
| EP | 2253888 | B1 | 10/2013 |
| JP | H07071757 | A | 3/1995 |
| JP | 2010025541 | A | 2/2010 |
| KR | 20190101554 | A | 9/2019 |
| WO | 9011929 | A1 | 10/1990 |
| WO | 2015150114 | A1 | 10/2015 |

OTHER PUBLICATIONS

PCT International Search Report and Written Opinion of International Searching Authority mailed Feb. 12, 2021 corresponding to PCT International Application No. PCT/EP2020/085563 filed Dec. 10, 2020.

Lechner, Christof, and Jörg Seume, Stationary Gas Turbines, Berlin, Springer Published 2003 pp. 453-465; 2003; English machine translation attached.

Galeazzo, Flavio Cesar Cunha, et al. "Measurement and Simulation of Turbulent Mixing in a Jet in Crossflow"; Division of Combustion Technology, Engler-Bunte-Institute—Karlsruhe Institute of Technology, Karlsruhe, Germany; Siemens Energy, Inc. EN 323, Siemens AG PG PE3; Proceedings of ASME Turbo Expo 2010: Power for Land, Sea and Air GT2010 Jun. 14-18, 2010, Glasgow, UK; 2010.

Düsing, K. Michael, et al. "Effect of Mixing Quality On NOX Emissions in Reheat Combustion of GT24 & GT26 Engines"; Alstom Power, Baden, Switzerland; Proceedings of ASME Turbo Expo 2011 GT2011 Jun. 6-10, 2011, Vancouver, British Columbia, Canada; 2011.

Henze, Marc, "Experimental investigation of flow and heat transfer in cooling channels with vortex-generating elements", Stuttgart, Germany ITLR; 2007; English abstract on pages numbered xvii-xviii.

* cited by examiner

BURNER COMPONENT OF A BURNER, AND BURNER OF A GAS TURBINE HAVING A BURNER COMPONENT OF THIS TYPE

CROSS REFERENCE TO RELATED APPLICATIONS

This application is the US National Stage of International Application No. PCT/EP2020/085563 filed 10 Dec. 2020, and claims the benefit thereof. The International Application claims the benefit of German Application No. DE 10 2020 207 940.4 filed 26 Jun. 2020 and claims the benefit of European Application No. EP20167166 filed 31 Mar. 2020. All of the applications are incorporated by reference herein in their entirety.

FIELD OF INVENTION

The invention relates to a burner component of a burner for use in a gas turbine. The object under consideration here of the burner component is to effect or promote the swirling of combustion air with fuel.

BACKGROUND OF INVENTION

For advantageous combustion with the aim of preventing harmful substances as far as possible, it is essential that homogeneous mixing of the fuel in the combustion air takes place before the combustion. Different solutions are employed in the prior art in order to achieve this. In many cases, these are based on effecting swirling of the combustion air with the fuel. Although corresponding swirling causes resistance in the flow, the required combustion largely free of harmful substances cannot generally be achieved without swirling.

In order to swirl the combustion air with the fuel, disruptive elements which deflect the flow and thus effect swirling are generally arranged in the flow path. In many cases, blade-like structures are used for this purpose.

It is furthermore known to arrange disruptive contours which effect swirling of the combustion air on the surface along the flow path. It is thus known inter alia to arrange so-called vortex generators, which project accordingly into the flow duct, on the wall of the flow duct. EP 0775869 and EP 0619 457 disclose exemplary embodiments thereof. In both cases, vortex generators, which have the shape of an isosceles triangle inclined in a downstream direction starting from the wall of the flow duct when viewed in the direction of the flow, are arranged in the flow duct for the combustion air. A triangular shape in the form of a right-angled triangle also results therefrom in the case of a side view transverse to the direction of flow. A triangular shape also exists in a view perpendicular to the wall of the flow duct, transverse to the direction of flow.

This design of vortex generators with a triangular shape from three perspectives has proved to be suitable as almost the sole embodiment of such vortex generators and as a result is implemented as the standard design.

Independently of the type of flow path and the design of the required means for homogeneously mixing the combustion air with the fuel, it is necessary to minimize the flow resistance but nevertheless ensure adequate mixing.

SUMMARY OF INVENTION

An object of the present invention is therefore to effect improved mixing with the lowest possible resistance.

The object set is achieved by an embodiment according to the invention of a burner component, a burner lance as a burner component, and a burner with the corresponding burner component. Advantageous embodiments are the subject of the subclaims.

The intended use of the generic burner component is as a component of a burner. The type of burner is for the moment irrelevant here but the burner component is advantageously used in a burner of a gas turbine. It is obvious here that the burner should be arranged on the upstream side of a combustion chamber. The burner here has a flow duct in which combustion air flows from upstream to downstream in a direction of flow. The flow duct is here necessarily delimited by a wall. The burner component now here comprises, at least in some places, the wall adjoining the flow duct as a wall section.

A plurality of spray nozzles are generically arranged on the wall section. It is for the moment irrelevant how fuel is supplied to the spray nozzles. At least, the spray nozzles are provided in order to enable the introduction of fuel into the flow duct. The spray nozzles are consequently connected to a fuel duct for the moment irrespective of how the latter is designed or arranged.

A plurality of vortex generators are furthermore situated on the wall section physically close to the spray nozzles. The vortex generators are here each arranged on the wall section and thus project into the flow duct. The vortex generators accordingly effect swirling of the combustion air as an obstacle in the flow duct.

It is thus furthermore generically provided that the vortex generators have a shape with a leading edge running on the wall section. The leading edge represents the limit of the vortex generator on the upstream side. Depending on the shape of the wall section, the leading edge can have both a curved and a straight profile. The leading edge here runs along (not necessarily exactly in) a transverse direction which is oriented transversely to the direction of flow and thus on the wall section or tangentially to the wall section.

A trailing edge is situated on the downstream side of the respective vortex generator. The trailing edge extends here in each case along (not necessarily exactly in) a vertical direction. The vertical direction is oriented transversely to the wall section and transversely to the direction of flow. The end of the trailing edge at the wall section forms a base point, wherein an end point is situated opposite it on the trailing edge.

The vortex generator here has a vortex generator height which is measured in the vertical direction and extends here from the base point as far as the end point.

The respective vortex generator is delimited, on the one hand, by two side faces arranged opposite each other. Starting from the trailing edge, the side faces run upstream in the direction of the opposite edge ends of the leading edge. The vortex generator is furthermore delimited by an inclined face which begins at the leading edge and runs as far as the end point. The inclined face is consequently delimited laterally at least in some places by the side faces.

In the embodiment under consideration here, the vortex generators have an approximately triangular shape when viewed from different sides. This is the case when viewing the inclined face both in the direction of flow and in the vertical direction. The respective side face also appears with an approximately triangular shape when viewed in the transverse direction.

As a result, the vortex generator has approximately the form of a tetrahedron, wherein one face of the tetrahedron is formed by the wall surface and one edge of the tetrahedron is the leading edge and one edge is the trailing edge.

The vortex generator has a vortex generator length which is measured in the direction of flow and here extends from the leading edge as far as the base point. If the leading edge does not extend in a straight line in the transverse direction, that point on the leading edge which is arranged furthest upstream should be chosen. This point can be the center but is generally an edge end of the leading edge in the case of a non-plane wall section.

Whilst a plane inclined face is provided in the prior art for the specific form of the vortex generators, according to the invention the inclined face is now designed with a concave curvature. In other words, the inclined face represents a curved surface formed so that it is depressed into the vortex generator.

Although at first glance the change in the inclined face of the vortex generator from a plane face to a concavely curved shape may appear to be irrelevant in terms of effective mixing, it has, however, been shown that better, homogeneous distribution of the fuel can be achieved compared with a regular vortex generator with the same flow resistance. As a result, this causes an albeit small improvement in terms of combustion which is as free of harmful substances as possible.

It has been shown to be advantageous both in terms of construction and production and in terms of the desired outcome when swirling the combustion air if the inclined face has a constant radius of curvature and in this respect the inclined face forms a section of a spherical surface.

A curvature which has a defined deviation from an inclined plane has been shown to be advantageous in terms of improving the mixing with the change from a plane to a concave inclined face. The inclined plane is here defined by an end point and two further points of the peripheral edge of the inclined face such that the inclined face lies completely below the inclined plane. A face depth can furthermore be determined, wherein the face depth represents the greatest spacing from the concave inclined face to the inclined plane.

A face depth of at least 0.05 times the vortex generator height and no more than 0.4 times the vortex generator height is advantageous here. A face depth of at least 0.1 times the vortex generator height is particularly advantageous. It is furthermore particularly advantageous if the face depth corresponds to no more than 0.3 times the vortex generator height.

In contrast to the usual plane design of the side faces, it has been shown to be advantageous to design the side faces so that they curve outward. The side faces here have a convex curvature in a section through the vortex generator along a plane transverse to the vertical direction. In this respect, the respective side faces very simply form a section of a cylindrical surface.

Independently of the concavely shaped inclined face according to the invention, a vortex generator has particular features, in particular size ratios, such that an advantageous effect is obtained.

It is advantageous here if the width in the transverse direction corresponds to at least 0.5 times the vortex generator length. The width of the vortex generator is particularly advantageously at least 0.8 times the vortex generator length.

In addition, it is advantageous if the vortex generator length corresponds to at least 0.5 times the width of the vortex generator. A vortex generator length of at least 0.8 times the width of the vortex generator is particularly advantageous.

The advantageous effect of the vortex generator is furthermore ensured if the vortex generator length corresponds to at least 0.8 times the vortex generator height. A vortex generator length of at least the vortex generator height is particularly advantageous.

The vortex generator height should, however, not exceed 1.5 times the vortex generator length. It is particularly advantageous if the vortex generator height is less than the vortex generator length.

Advantageous mixing of fuel in the combustion air is achieved if at least one spray nozzle is arranged in the immediate area of influence of the vortex generator. The spray nozzle is here formed very simply by a round bore with a nozzle diameter.

For the advantageous spraying of fuel and swirling it with the aid of the vortex generators, a nozzle diameter of the spray nozzle corresponds to at least 0.1 times the vortex generator height. A nozzle diameter of at least 0.2 times the vortex generator height is particularly advantageous.

Likewise, the nozzle diameter in relation to the vortex generator should, however, not be chosen to be too large because otherwise the advantageous effect of the vortex generator is lost. The nozzle diameter should therefore be smaller than 0.6 times the vortex generator height. A nozzle diameter of no more than 0.4 times the vortex generator height is particularly advantageous.

In the case of non-round spray nozzles, an equivalent nozzle diameter should be determined from the cross-sectional area of the spray nozzle.

To this end, in a first alternative embodiment, a spray nozzle can advantageously be arranged on at least one side of the vortex generator, in a side face of the vortex generator or in the immediately adjoining wall section at a distance from the base point of no more than 0.3 times the vortex generator height. It is particularly advantageous here if the spacing of the spray nozzles (irrespective of whether they are arranged in the side face or the wall section) from the base point corresponds to no more than 0.2 times the vortex generator height. A spray nozzle can furthermore advantageously be arranged on both sides of the vortex generator.

In a second advantageous alternative embodiment, the spray nozzles are arranged centrally with respect to the respective vortex generator. In combination with the orientation of the vortex generator with an inclined face rising in a downstream direction, advantageous mixing of the fuel in the combustion air is effected downstream from the vortex generator.

In the case of central arrangement of the spray nozzles, it can, on the one hand, be advantageously provided that the spray nozzles are arranged directly on the vortex generator at the trailing edge (the spray nozzles in this respect interrupt the trailing edge or reduces its length at the base point).

Alternatively, the spray nozzle can be arranged downstream from the vortex generator in the wall section.

It is advantageous here if the distance of the spray nozzle from the base point corresponds to no more than 0.5 times the vortex generator height. It is particularly advantageous if the distance corresponds to no more than 0.3 times the vortex generator height. The advantageous influence of the vortex generator with the concave inclined face is thus optimally exploited in order to obtain the best possible mixing of the fuel in the combustion air.

It has likewise proven to be advantageous if, when arranged on the wall section, the spray nozzle is arranged at a distance from the base point of at least 0.1 times the vortex generator height.

With regard to the position of the spray nozzles, the spacing from the edge of the spray nozzle is in each case considered for the above-stated advantageous distances. In the case of rounding at the base point, the base point is determined in an extension of the trailing edge without any rounding.

Further advantageous introduction of the fuel into the combustion air is enabled when at least one spray nozzle is arranged between in each case two vortex generators. Precisely one spray nozzle is particularly advantageously arranged centrally between the vortex generators. The relevant arrangement relates to the position in the transverse direction.

The at least one spray nozzle between the vortex generators is likewise, viewed in the direction of flow, positioned physically close to the base point. It is advantageous here if likewise the distance of the base point from the spray nozzle corresponds to no more than 0.5 times the vortex generator height. It has been shown to be particularly advantageous if the spray nozzle is arranged downstream from the base point at a maximum distance of 0.3 times the vortex generator height.

The plurality of vortex generators can be arranged next to one another and offset relative to one another in the direction of flow. The vortex generators are advantageously arranged next to one another at the same height in the direction of flow. In this respect, it is irrelevant whether other means for swirling the stream of air are arranged upstream or downstream outside the immediate area of influence of the vortex generators.

It can furthermore be provided that the vortex generators are arranged so that they are spaced apart from one another in the transverse direction. It has, however, been shown to be advantageous if the vortex generators directly adjoin one another. It is particularly advantageous here if, by virtue of the adjoining arrangement of the vortex generators, the respective adjacent inclined faces have a common edge section.

The burner component as part of a burner can fulfill different functions. For example, the burner component can form a tube section which surrounds the flow duct. The burner component can also form a subsection of a wall of the flow duct, wherein two of more subsections, for example each as a burner component, surround the flow duct. The wall can likewise be a surface of a swirl blade which is arranged in a flow duct. In each case, the burner component adjoins the flow duct when used as intended, in accordance with the intended object of effecting mixing of fuel into combustion air.

It is particularly advantageous here if the burner component forms a burner lance. The burner lance here has a rotationally symmetrical wall by means of which the flow duct surrounds the wall section of the burner component. In accordance with the round shape of the burner lance, the vortex generators are arranged so that they are distributed over the periphery of the wall section, the vortex generators being designed as described above.

Providing a burner component according to the invention results in the formation of a burner according to the invention which is used at a combustion chamber in its intended use.

The use of the burner in the combustion chamber of a gas turbine is particularly advantageous, wherein the burner component is furthermore advantageously a burner lance.

It is advantageous here if the burner comprises at least one mixing tube which surrounds the flow duct and is arranged upstream of the combustion chamber. The burner component used here with a design as described above is arranged centrally in the mixing tube.

It is particularly advantageous if a plurality of mixing tubes running in parallel which are arranged upstream of a common combustion chamber are used at the same time. In addition, a burner component as described above is used in each of the mixing tubes.

By virtue of the use of the burner component according to the invention in a mixing tube, advantageous mixing of fuel in the combustion air is effected and combustion which is largely free of harmful substances is thus enabled.

BRIEF DESCRIPTION OF THE DRAWINGS

An exemplary embodiment for a burner component according to the invention is illustrated in the following drawings, in which.

DETAILED DESCRIPTION OF INVENTION

Figure 1:
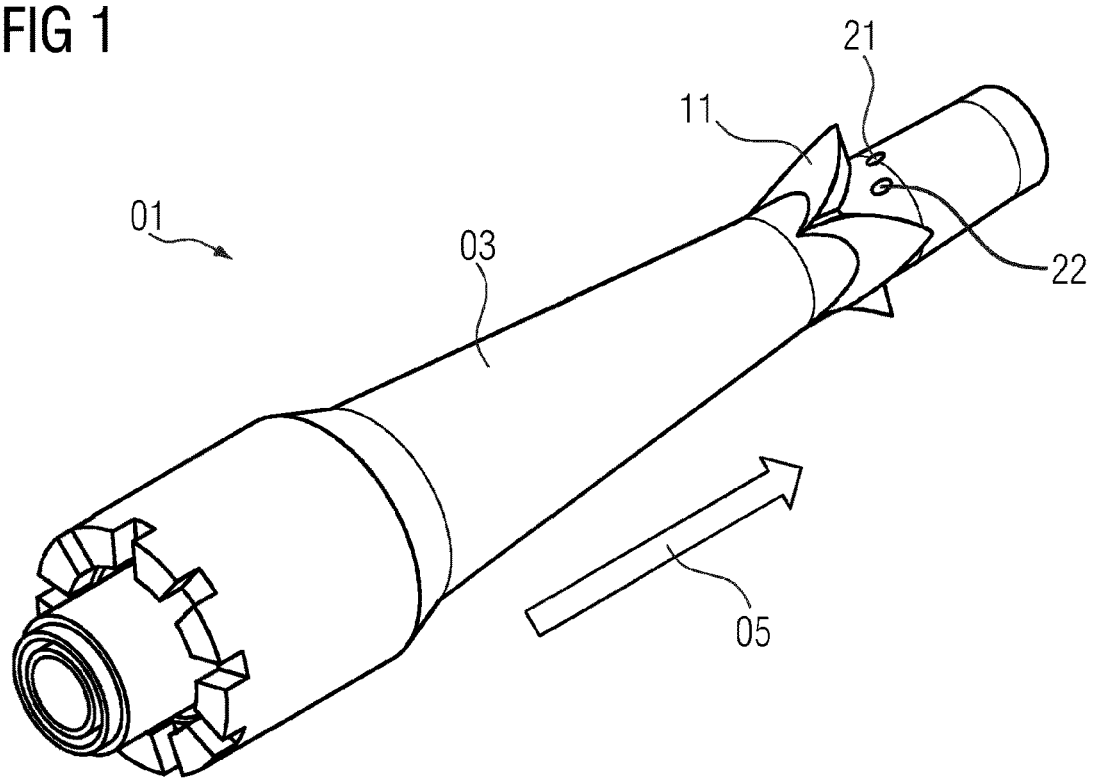
FIG. 1 shows a perspective view of a burner lance as a burner component.
Figure 2:
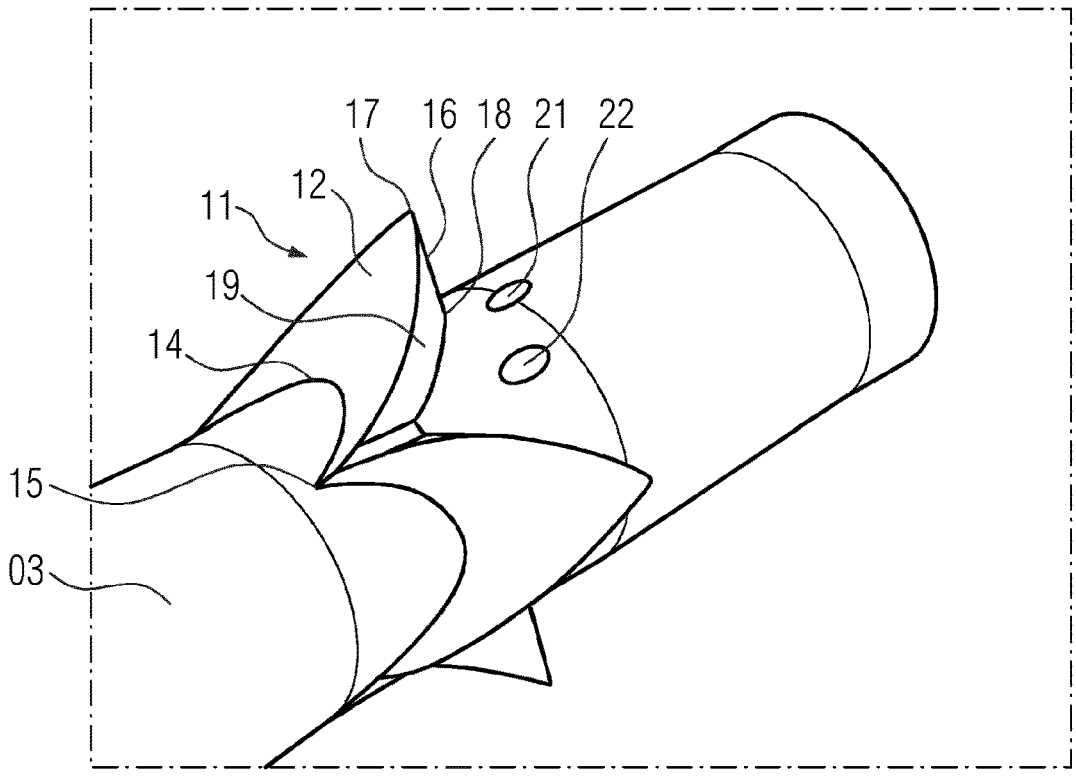
FIG. 2 shows a detailed view of the arrangement of vortex generators and spray nozzles.
Figure 3:
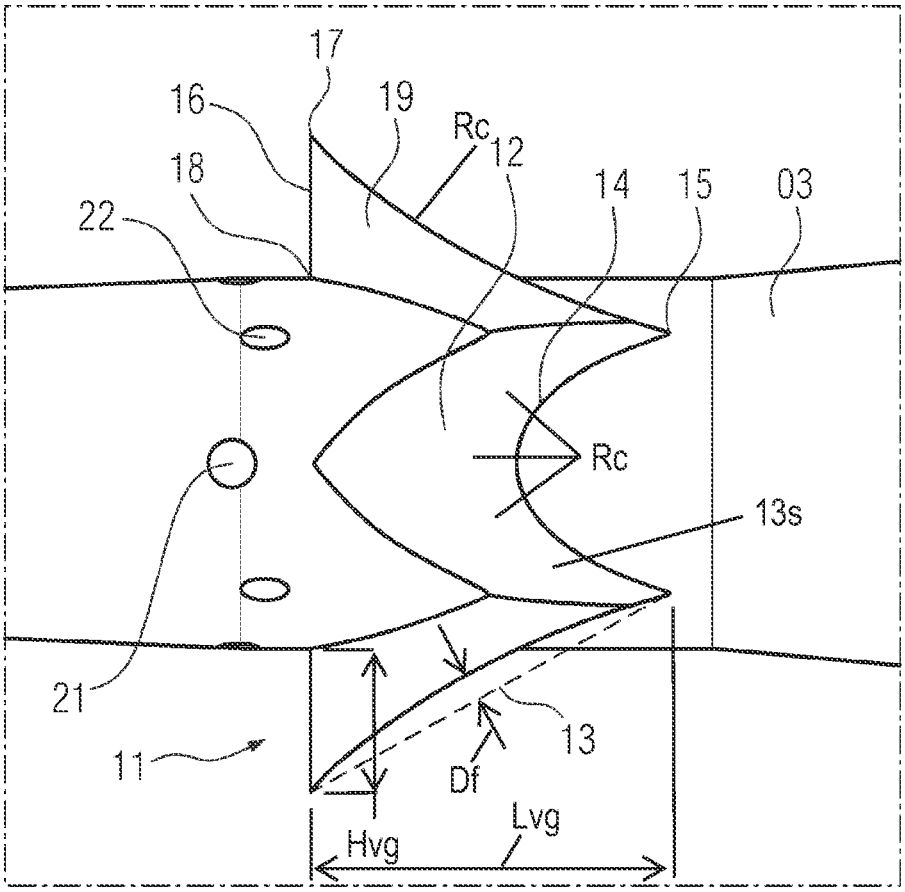
FIG. 3 shows a side view of FIG. 2.
Figure 4:
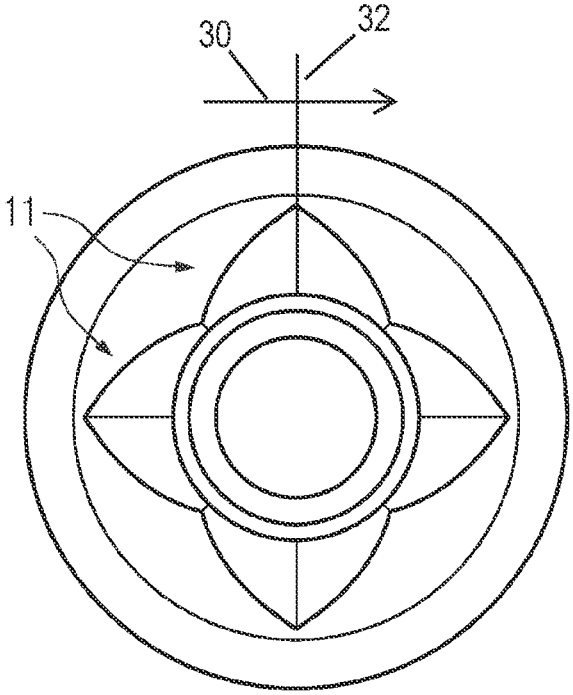
FIG. 4 shows a view of FIG. 1 counter to the direction of flow.
Figure 5:
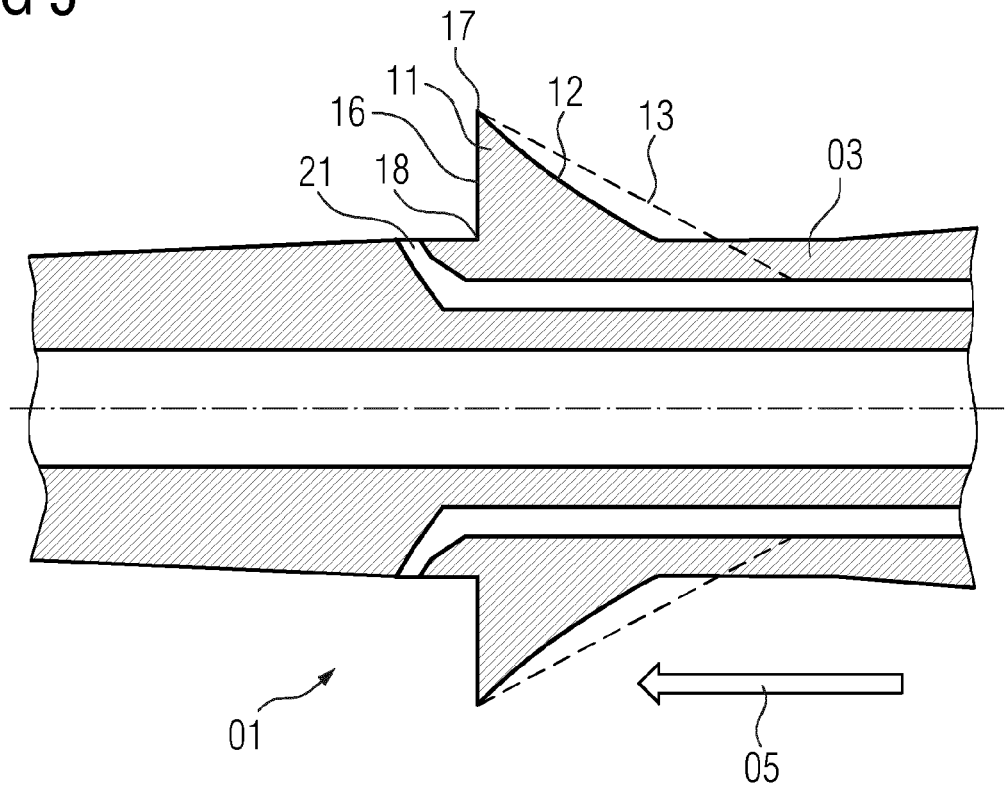
FIG. 5 shows a section through the burner lance in the region of the vortex generators.

An exemplary embodiment for a burner component 01 according to the invention in the form of a burner lance is shown in FIG. 1 in a perspective view. First of all, the typical rotationally symmetrical, elongated shape of the burner lance 01 can be seen. The slightly conical wall of the burner lance forms the wall section 03 of the burner component 01 as a delimiting surface for the flow duct which is present in the burner when used as intended. Said flow duct accordingly defines the direction of flow 05 from an upstream side to a downstream side.

Also visible is the arrangement of a plurality of vortex generators 11, arranged so that they are distributed over the periphery, which each have an approximately triangular shape, viewed from different directions. The vortex generator 11 thus has approximately the form of a tetrahedron. Also visible is the arrangement of a plurality of spray nozzles 21, 22 which are arranged downstream from the vortex generators 11.

FIGS. 2 to 5 now show in detail the design of the vortex generators 11 and the associated spray nozzles 21, 22.

The respective vortex generator 11 is delimited upstream by a leading edge 14. The leading edge 14 here runs in a transverse direction which is oriented perpendicularly to the direction of flow tangentially to the wall section 03. By virtue of the arrangement of the vortex generators 11 on the rotationally symmetrical wall section 03, the leading edge 14 is curved such that the two opposite edge ends 15 of the leading edge 14 are arranged furthest upstream. The vortex generator is delimited on the opposite side by the trailing edge 16 which extends approximately in a respective vertical direction from a base point 18 on the wall section 03 as far as an end point 17. The vertical direction is here oriented approximately perpendicularly to the direction of flow and perpendicularly to the wall section 03 at the base point 18.

The spacing from the base point 18 to the end point 17, measured in the vertical direction, here defines the vortex generator height Hvg.

The spacing from the trailing edge 16 to the edge ends 15, measured in the direction of flow 05, here defines a vortex generator length Lvg.

The respective vortex generator 11 is delimited laterally by two opposite side faces 19 which each extend from the trailing edge in the direction of the respective edge end 15 of the leading edge 14. As can be seen, the side faces 19 have a convexly curved shape.

The surface, essential for swirling the fuel in the combustion air, of the vortex generator forms the inclined face 12 which extends from the leading edge 14 to the end point 17. The inclined face 12 is delimited correspondingly in some places by cut edges with the two side faces 19. In this exemplary embodiment, it is provided that the vortex generators 11 are arranged so that they are adjacent to one another in such a way that in some places a common edge section of the adjacent inclined faces 12 results, starting from the respective edge end 15 as far as essentially the beginning of the side faces 19.

Although not immediately evident from the individual illustrations, it is clear from considering them collectively that the inclined face 12 has a convexly curved shape. This is the critical feature for obtaining the advantageous swirling and hence a further option for reducing harmful substances during the combustion. The inclined face 12 is here situated below a theoretical inclined plane 13. The inclined plane 13 is here defined by the end point 17 and the two edge ends 15 such that the inclined face 12 is arranged completely below the inclined plane 13. In this advantageous embodiment, the inclined plane 13 has a concave shape. Also in this example embodiment, the inclined face 13 has a constant radius of curvature Rc and in this respect the inclined face 13 forms a section of a spherical surface. In this advantageous embodiment, it is provided that the greatest spacing between the inclined face 12 and the theoretical inclined plane 13 corresponds as a face depth Df to 0.2 times the vortex generator height.

Also visible from the views is the advantageous arrangement of spray nozzles 21, 22. In this exemplary embodiment, it is provided that a spray nozzle 21 is in each case situated in the wall section 03, centrally behind a vortex generator 11. In this exemplary embodiment, the distance Dn from the edge of the respective spray nozzle 21 to the base point 18 of the trailing edge 16 is approximately 0.25 times the vortex generator height Hvg.

It is furthermore advantageously provided that a further spray nozzle 22 is arranged on the wall section 03 in each case between two vortex generators 11. The distance from the edge of the spray nozzle 22 to the base point 18 of the vortex generators 11 is here approximately 0.15 times the vortex generator height.

The invention claimed is:

1. A burner component configured to be used in a flow duct of a burner, wherein in the flow duct there is a combustion air flow flowing from upstream to downstream in a direction of the combustion air flow, the burner component comprising:

a wall section, a plurality of spray nozzles arranged in the wall section, and a plurality of vortex generators, wherein each of the plurality of vortex generators is arranged on the wall section and projects radially outward in a respective radial direction from the wall section and comprises:

a vortex generator length in the direction of the combustion air flow, a leading edge being located upstream in the direction of the combustion air flow and extending on the wall section, a trailing edge being located downstream in the direction of the combustion air flow and extending radially outward in the respective radial direction from a base point on the wall section to an end point, a first side face and a second side face opposite the first side face, and both the first side face and the second side face extend upstream from the trailing edge relative to the direction of the combustion air flow, and an inclined face extending from the leading edge to the end point, and wherein each of the inclined faces of each of the plurality of vortex generators is curved concavely in the direction of the combustion air flow, and curved concavely in a respective direction that is perpendicular to both the direction of the combustion air flow and the respective radial direction of the respective trailing edge, and each of the first side face and second side face of each of the plurality of vortex generators are curved convexly and transversely to the respective radial direction.

2. The burner component as claimed in claim 1, wherein each of the inclined faces of each of the plurality of vortex generators has a constant radius of curvature in the direction of the combustion air flow and in the respective direction that is perpendicular to both the direction of the combustion air flow and the respective radial direction of the respective trailing edge, and thereby defines a spherically concave section.

3. The burner component as claimed in claim 1, wherein each of the plurality of vortex generators comprises a face depth and a vortex generator height, and for each of the plurality of vortex generators, the face depth, defined as a greatest spacing from the inclined face to a corresponding inclined plane, corresponds to at least 0.05 times the vortex generator height and no more than 0.4 times the vortex generator height.

4. The burner component as claimed in claim 3, wherein for each of the plurality of vortex generators, the face depth corresponds to at least 0.1 times the vortex generator height.

5. The burner component as claimed in claim 3, wherein for each of the plurality of vortex generators, the face depth corresponds to no more than 0.3 times the vortex generator height.

6. The burner component as claimed in claim 1, wherein one spray nozzle of the plurality of spray nozzles is aligned with respect to one vortex generator of the plurality of vortex generators.

7. The burner component as claimed in claim 6, wherein the one spray nozzle is arranged within an area away from the trailing edge of the one vortex generator aligned with the one spray nozzle.

8. The burner component as claimed in claim 1, wherein one spray nozzle of the plurality of spray nozzles is arranged between two vortex generators of the plurality of vortex generators.

9. The burner component as claimed in claim 8, wherein the one spray nozzle arranged between the two vortex generators is arranged at a distance in the direction of the combustion air flow from the base point of one of the two vortex generators of approximately 0.15 times a vortex generator height of the one of the two vortex generators.

10. The burner component as claimed in claim 8, wherein the inclined faces of the two vortex generators of the plurality of vortex generators merge and form a common edge section.

11. A burner lance, comprising:

the burner component as claimed in claim 1, wherein the burner component comprises a rotationally symmetrical wall as the wall section and comprises the plurality of vortex generators, wherein the plurality of vortex generators are distributed over a periphery of the wall section.

12. The burner comprising the burner component as claimed in claim 1, wherein the burner is configured to be used in a combustion chamber.

13. The burner as claimed in claim 12, wherein the combustion chamber is adapted for use in a gas turbine.

14. The burner as claimed in claim 12, further comprising a burner lance comprising the burner component of claim 1.

15. The burner as claimed in claim 12, further comprising:

a mixing tube which defines an outer perimeter of the flow duct and is arranged upstream of the combustion chamber, and the burner component is arranged centrally in the mixing tube.

16. The burner as claimed in claim 15, wherein the mixing tube is a plurality of the mixing tubes, wherein the plurality of the mixing tubes are parallel to each other and are arranged upstream of the combustion chamber, wherein the burner component is a plurality of the burner components, and wherein a respective burner component of the plurality of the burner components is arranged centrally in a corresponding mixing tube of the plurality of the mixing tubes.

17. The burner component as claimed in claim 1, wherein the burner component is adapted for use in a combustion chamber of a gas turbine.

18. The burner component as claimed in claim 1, wherein only one spray nozzle of the plurality of spray nozzles is arranged between each pair of adjacent vortex generators of the plurality of vortex generators.

* * * * *